US006949145B2

(12) United States Patent
Banerjee et al.

(10) Patent No.: US 6,949,145 B2
(45) Date of Patent: Sep. 27, 2005

(54) VAPOR-ASSISTED CRYOGENIC CLEANING

(75) Inventors: Souvik Banerjee, Fremont, CA (US); Harlan Forrest Chung, Castro Valley, CA (US)

(73) Assignee: BOC, Inc., Murray Hill, NJ (US)

( * ) Notice: Subject to any disclaimer, the term of this patent is extended or adjusted under 35 U.S.C. 154(b) by 0 days.

(21) Appl. No.: 10/403,147

(22) Filed: Mar. 31, 2003

(65) Prior Publication Data

US 2003/0188763 A1 Oct. 9, 2003

Related U.S. Application Data

(60) Provisional application No. 60/369,852, filed on Apr. 5, 2002.

(51) Int. Cl.[7] ..... B08B 7/04; B08B 5/00

(52) U.S. Cl. ..... 134/1; 134/6; 134/7; 134/26; 134/31; 134/37

(58) Field of Search ..... 134/1, 1.3, 6, 7, 134/26, 28, 30, 31, 34, 37

(56) References Cited

U.S. PATENT DOCUMENTS

| | | | | |
|---|---|---|---|---|
| 4,264,641 | A | | 4/1981 | Mahoney et al. |
| 5,377,705 | A | | 1/1995 | Smith, Jr. et al. ..... 134/95.3 |
| 5,775,127 | A | | 7/1998 | Zito |
| 5,796,111 | A | | 8/1998 | Mahoney |
| 5,853,962 | A | | 12/1998 | Bowers |
| 5,908,510 | A | | 6/1999 | McCullough et al. |
| 5,928,434 | A | * | 7/1999 | Goenka ..... 134/2 |
| 5,931,721 | A | | 8/1999 | Rose et al. |
| 5,967,156 | A | * | 10/1999 | Rose et al. ..... 134/7 |
| 6,033,484 | A | | 3/2000 | Mahoney |
| 6,036,581 | A | | 3/2000 | Aoki |
| 6,066,032 | A | | 5/2000 | Borden et al. ..... 451/80 |
| 6,203,406 | B1 | | 3/2001 | Rose et al. |
| 6,231,775 | B1 | | 5/2001 | Levenson et al. |
| 6,306,564 | B1 | | 10/2001 | Mullee ..... 430/329 |
| 6,332,470 | B1 | | 12/2001 | Fishkin et al. |
| 6,565,920 | B1 | * | 5/2003 | Endisch ..... 427/240 |
| 2003/0188763 | A1 | | 10/2003 | Banerjee et al. |
| 2004/0018803 | A1 | | 1/2004 | Boumerzoug et al. |

OTHER PUBLICATIONS

U.S. Appl. No. 10/324,221, filed Dec. 19, 2002, Banerjee et al.

Jointly written by: European Elect. Component Manufactures Assc., Japan Elect. & Information Tech. Industries Assc., Korea Semiconductor Industry Assc., Taiwan Semiconductor Industry Assc., International Technology Roadmap for Semiconductors 2001 Edition *Executive Summary*—pp. 12–16.

Edited by Werner Kern, Noyes Publications, 1993. "Handbook of Semiconductor Wafer Cleaning Technology Science, Technology, and Applications"—pp. 152, 181, 182.

Edited by R.P. Donovan, Marcel Dekker Inc. "Particle Control for Semiconductor Manufacturing"—pp. 359, 361–364.

* cited by examiner

*Primary Examiner*—Michael Barr
*Assistant Examiner*—Saeed Chaudhry
(74) *Attorney, Agent, or Firm*—Joshua L. Cohen

(57) ABSTRACT

The present invention is directed towards the use of a reactive gas or vapor of a reactive liquid prior to or in combination with cryogenic cleaning to remove contaminants from the semiconductor surfaces or other substrate surfaces requiring precision cleaning. The reactive gas or vapor is selected according to the contaminants to be removed and the reactivity of the gas or vapor with the contaminants. Preferably, this reaction forms a gaseous byproduct which is removed from the substrate surface by the flow of nitrogen across the surface.

22 Claims, 2 Drawing Sheets

VAPOR-ASSISTED CRYOGENIC CLEANING

The present application claims priority from U.S. patent application No. 60/369,852, filed on Apr. 5, 2002.

FIELD OF THE INVENTION

The present invention relates to the use of a reactive gas or vapor of a reactive liquid, with or without a free radical generator, and either simultaneously or sequentially, with cryogenic cleaning to aid in the removal of foreign materials (FM), e.g. particles, films, and other contaminants, from semiconductor surfaces and other surfaces involved in precision cleaning.

BACKGROUND OF THE INVENTION

The demands for greater switching speed and circuit performance have seen the advent of new dielectric materials (dielectric constant of <3) and metals to reduce the RC delay constant in circuits. The metal of choice, which is copper, has added several challenges to the process integration scheme. For aluminum interconnects, the metal patterning was performed by reactive ion etching (RIE) of the aluminum followed by dielectric deposition. With copper, the dielectric film is first deposited and etched to form vias and trenches followed by the deposition of copper in those etched features. The excess copper is then removed using chemical mechanical polishing (CMP) to planarize the surface for subsequent layers of film. This method of forming copper interconnects for the back-end-of-line (BEOL) is known as the Dual Damascene process.

Following the dielectric etch to form the vias and trenches, a large amount of fluoropolymeric residue is left both on the surface of the wafer and on the inside of features as seen in FIG. 1. These residues are generated during the etching process, partly for sidewall passivation during anisotropic etching. The etch residue has to be cleaned prior to the deposition of the successive film layers: the copper barrier Ta/TaN film, copper seed layer, and finally the electrochemical filling of the features with copper in the Damascene process.

The dimensions of the features used in the interconnects at the BEOL are currently around 0.13 $\mu$m. For cryogenic cleaning to work effectively in removing the sidewall residues from inside the features, as shown in FIG. 1, the cryogenic particles must be less than 0.13 $\mu$m in size. As well, these particles must arrive at the surface of the wafer with enough velocity to impart the momentum transfer required to dislodge the sidewall residue.

There are three mechanisms by which surface cleaning is done: 1) momentum transfer by cryogenic particles to overcome the force of adhesion of slurry particles to the wafer surface, 2) drag force of the cleaning gases to remove the dislodged particles off the surface of the wafer, and 3) the dissolution of organic contaminants by liquid formed at the interface of the cryogenic particle and the wafer surface.

In $CO_2$ cryogenic cleaning, liquid $CO_2$ at a pressure of about 850 psi from a purified source is made to expand through the orifice of a specially designed nozzle intended to make the expansion a constant enthalpy process. The expansion of liquid $CO_2$ through the nozzle creates solid and gaseous $CO_2$ in a highly directional and focused stream. Due to the gas flow over the wafer surface, a boundary layer is formed. The $CO_2$ cryogenic particles must travel through the boundary layer to arrive at the wafer surface and at the contaminant particle to be removed. During the flight through the boundary layer, their velocity decreases due to the drag force on them by the gaseous $CO_2$ in the boundary layer. Assuming the thickness of the boundary layer to be h, a snow particle must enter the layer with a normal component of velocity equal to at least h/t where t is the time taken to cross the boundary layer and arrive at the wafer surface. The relaxation time of the particle crossing the boundary layer is given in equation (1) as the following:

$$\tau = \frac{2a^2\rho_p C_c}{9_\eta} \tag{1}$$

where:

a is the particle radius $\rho_p$ is the particle density $\eta$ is the viscosity of the gas $C_c$ is the Cunningham slip correction factor given as in equation (2)

$$C_c = 1 + 1.246(\lambda/a) + 0.42(\lambda/a)\exp[-0.87(a/\lambda)] \tag{2}$$

where $\lambda$ is the mean free path of gas molecules. Since the $CO_2$ cryogenic cleaning is conducted at atmospheric pressure, the Cunningham slip correction factor becomes equal to 1 in equation (1) for cryogenic particles larger than 0.1 $\mu$m in size.

Thus, for $CO_2$ snow particles to have sufficient momentum to remove foreign material from the wafer surface and from inside the features, the time to cross the boundary layer must be less than the relaxation time, in which case they will arrive at the surface with greater than 36% of the initial velocity. Equation 1 shows that the relaxation time decreases with particle size. Therefore, the smaller-sized particles will not be able to arrive at the wafer surface with sufficient velocity to effectively clean the inside walls of the submicron vias and trenches.

The prior art processes generally use $CO_2$ or argon cryogenic spray for removing foreign material from surfaces. As examples, see U.S. Pat. No. 5,931,721 entitled Aerosol Surface Processing; U.S. Pat. No. 6,036,581 entitled Substrate Cleaning Method and Apparatus: U.S. Pat. No. 5,853,962 entitled Photoresist and Redeposition Removal Using Carbon Dioxide Jet Spray; U.S. Pat. No. 6,203,406 entitled Aerosol Surface Processing; and U.S. Pat. No. 5,775,127 entitled High Dispersion Carbon Dioxide Snow Apparatus. In all of the above prior art patents, the foreign material is removed from a relatively planar surface by physical force involving momentum transfer to the contaminants. However, such cleaning methods are inadequate for features with high aspect ratios such as in vias and trenches in the back-end-of-line integrated device fabrication process where removal of small submicron particles and complex polymeric residues, as generated by dielectric etch processes, is required.

U.S. Pat. No. 6,332,470 entitled Aerosol Substrate Cleaner discloses the use of vapor only or vapor in conjunction with high pressure liquid droplets for cleaning semiconductor substrate. Unfortunately, the liquid impact does not have sufficient momentum transfer capability as solid $CO_2$ and will therefore not be as effective in removing the smaller-sized particles. U.S. Pat. No. 5,908,510 entitled Residue Removal by Supercritical Fluids discloses the use of cryogenic aerosol in conjunction with supercritical fluid or liquid $CO_2$. Since $CO_2$ is a non-polar molecule, the solvation capability of polar foreign material is significantly reduced. Also, since the liquid or supercritical $CO_2$ formation requires high pressure (greater than 75 psi for liquid and 1080 psi for supercritical), the equipment is expensive. U.S.

Pat. No. 6,231,775 proposes the use of sulfur trioxide gas by itself or in combination with other gases for removing organic materials from substrates as in ashing. Such vapor phase cleaning is inadequate for removing cross-linked photoresist formed during the etching in a typical dual Damascene integration scheme using low k materials such as carbon doped oxides.

As such, there remains a need for the effective and efficient removal of homogeneous and inhomogeneous contaminants consisting of cross-linked and bulk photoresist, post-etch residues, and sub-micron sized particulates both from the surface of the wafer as well as from inside high aspect ratio features.

BRIEF DESCRIPTION OF THE FIGURES

Embodiments of the present invention are described with reference to the figures in which.

SUMMARY OF THE INVENTION

Figure 1A:
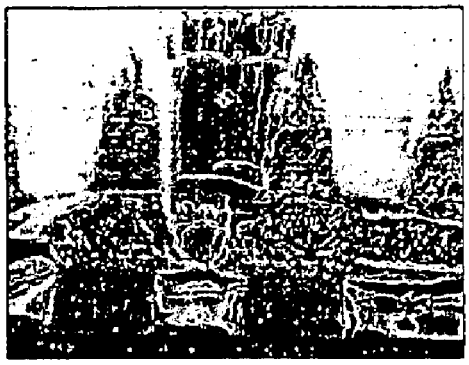
FIG. 1 shows the cleaning of the post-trench etch residues in a dual-damascene structure. The left image is the SEM of the post-trench etch structure with etch residues present. The right image is the SEM of the post-trench etch structure after a sequence of plasma and wet clean steps.
Figure 1B:
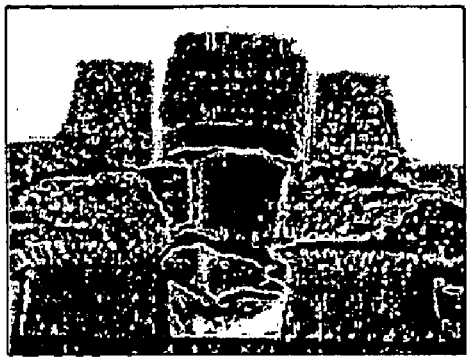

The invention comprises the use of a reactive gas or the vapor of a reactive liquid which can diffuse into the high aspect ratio features or through a layer of contaminants film and chemically react with the foreign material. Cryogenic cleaning will also be used, either sequentially or simultaneously, with the reactive gas or vapor cleaning to remove the contaminants and films from the surfaces and from inside patterned features of semiconductors and other substrates requiring precision cleaning of their surfaces.

DETAILED DESCRIPTION

The present invention comprises the use of a reactive gas or the vapor of a reactive liquid either simultaneously or sequentially with cryogenic cleaning. The reactive gas or vapor used in the process of the present invention is selected according to its reactivity with the contaminants on the substrate surface. After reacting with these contaminants, it also preferably produces byproducts in a gaseous form. (Hereinafter, for ease of reference in the description of the present invention, references to reactive gas may include reactive vapors of a liquid and references to reactive vapors may include reactive gases.) The reactive gas or vapor preferably stays in contact with the substrate surface for up to 20 minutes, preferably less than 10 minutes, and more preferably less than 2 minutes.

Examples of the vapor of a reactive liquid which may be used in the present process may be the vapor of a high vapor pressure liquid and include, but not limited to, acetone, ethanol-acetone mixtures, isopropyl alcohol, methanol, methyl formate, methyl iodide, and ethyl bromide. It may also be another gas such as ozone, water vapor, hydrogen, nitrogen, nitrogen oxides, nitrogen trifluoride, helium, argon, neon, sulfur trioxide, oxygen, fluorine, or fluorocarbon gases or combinations of gases. The gas or vapor should be reactive with the organic photoresist as well as the fluoropolymer etch residue inside the features. As well, the reaction byproducts are preferably gaseous so that they can be removed from the cleaning chamber by the flow of nitrogen gas. Preferred gases and vapors include isopropyl alcohol, ethanol-acetone mixtures, methanol, ozone, water vapor, nitrogen trifluoride, sulfur trioxide, oxygen, fluorine and fluorocarbon gases.

In post-etch cleaning applications, cryogenic particles cannot get inside the high aspect ratio features of vias and trenches. Vapor is needed to diffuse into these features effectively. The vapor will then chemically react with the polymeric residue and convert it to gaseous by-products which can be removed from the surface by a flow of nitrogen across the substrate surface. Alternatively, the vapor can be introduced in a separate chamber kept under low pressure. The vapor phase reaction in this chamber could be done at temperatures of up to 200° C. Following the vapor clean, the wafers may be transferred to a second cleaning chamber at atmospheric pressure where the cryogenic cleaning can take place.

During the process, the vapor may condense on the wafer surface. With the proper choice of vapors, the condensation could also lower the Hammaker constant and hence the force of adhesion of particles to surfaces. This condensation would thereby help in the particle removal by the $CO_2$ cryogenic cleaning.

In semiconductor wafer cleaning processes, the foreign material to be removed includes not only particle contaminants but also films of organic, inorganic, and metal-organic residues at various steps in microelectronic manufacturing both in FEOL (front-end-of-line) and BEOL processes. These films cannot be removed by purely physical mechanisms. Chemical assistance to any physical mechanism of removal is required to meet cleanliness requirements. In the present invention, the gas phase cleaning is the chemical means of cleaning whereas the cryogenic cleaning is predominantly the physical mechanism of cleaning. The two processes working in tandem or in sequence are able to completely remove the homogeneous or inhomogeneous foreign materials.

The reactivity of the gas or vapor of a reactive liquid with the contaminants may be further increased using a free radical initiator such as ultra violet light, X-ray, Excimer laser, corona discharge or plasma to generate reactive chemical species. It is combined with the physical cleaning of snow or cryogenic aerosols to remove the non-reactive foreign material. Similar cleaning mechanisms are seen in wet cleaning and dual frequency plasma cleaning using downstream MW plasma to generate the chemical species for reaction with the contaminant and RF plasma to generate the ion bombardment.

In one embodiment of the present invention in combination with $CO_2$ cryogenic cleaning, the vapor of a reactive liquid is sprayed through a nozzle attached to the same arm as a $CO_2$ cryogenic nozzle. The nozzle may be a small stainless steel bore, ¼ to ½" in diameter, or a specially designed nozzle with corona wire along the axis to initiate discharges in the vapor. The nozzle is preferably at an angle of approximately 10°–90° to the substrate surface. The vapor may also be sprayed through a showerhead positioned above the substrate surface to ensure uniform coverage of the substrate surface. During the vapor delivery, the substrate is preferably kept at the same temperature as the vapor. If condensation of the vapor is desired, the substrate may be kept at a temperature below the vapor to initiate condensation of the vapor into a thin film of liquid on the substrate surface. However, if desired, the vapor may be made reactive with the assistance of a free radical initiator such as ultraviolet light, x-ray, excimer laser, corona discharge, or plasma. This step is generally included in the process when the vapor is not sufficiently reactive for a given contaminant type. The vapor is sprayed onto the substrate surface for preferably up to twenty minutes. It may be sprayed continuously or intermittently. Preferably, a single type of vapor is used but a mixture of vapors may be used simultaneously or sequentially, if preferred, to remove particular foreign materials.

Figure 2:
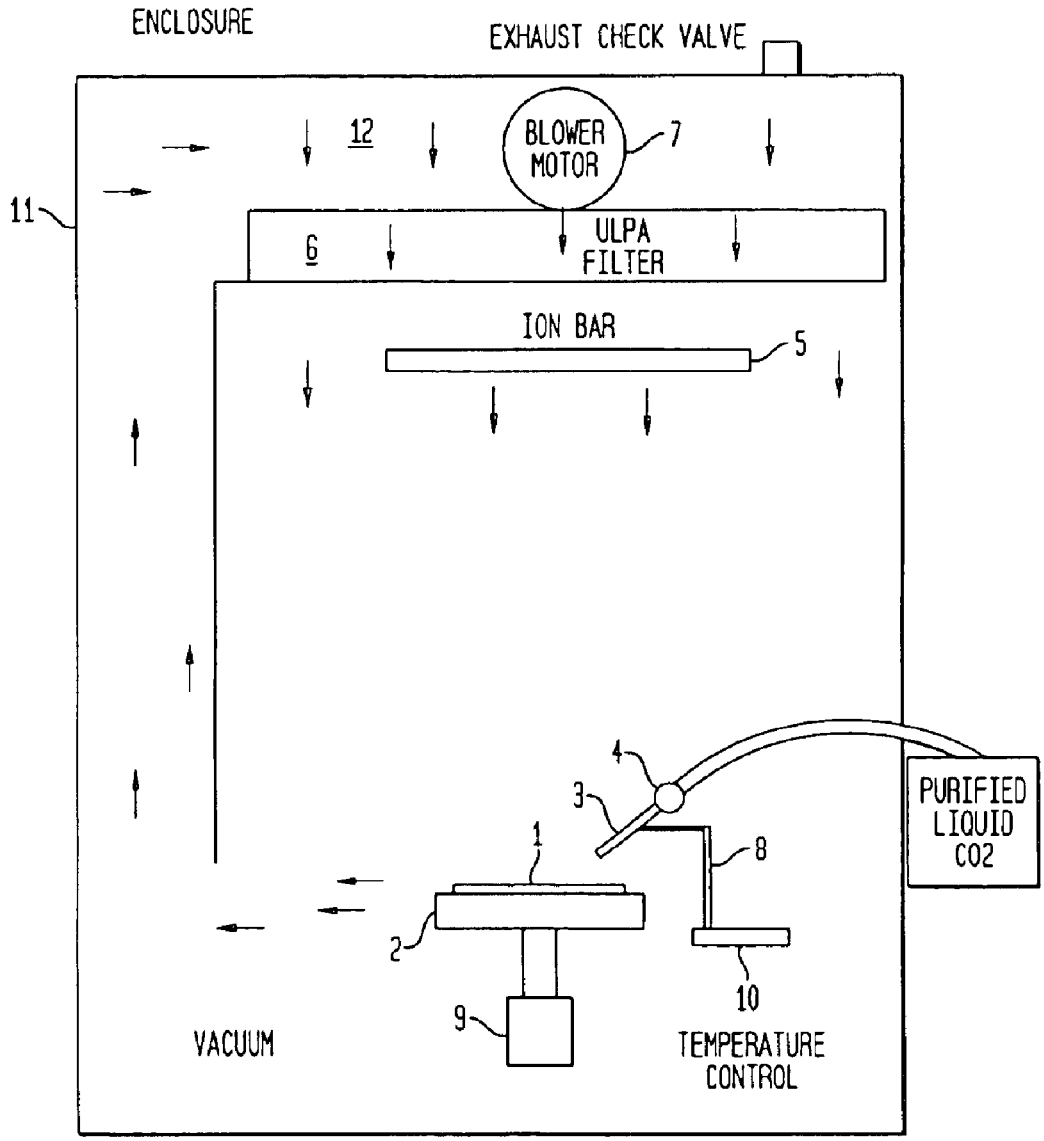
FIG. 2 shows a schematic diagram of a conventional $CO_2$ cryogenic cleaning system.

Following the application of vapor, the $CO_2$ cryogenic cleaning is performed. Cryogenic cleaning is well known within the industry and any well known technique may be used. A standard $CO_2$ cryogenic cleaning process is described in U.S. Pat. No. 5,853,962, which is incorporated by reference. As an example of a typical $CO_2$ cryogenic cleaning system, reference is made to the system 11 shown in FIG. 2. This system comprises a cleaning container 12 in which system gases are circulated in the general direction indicated by the arrows in FIG. 2. The cleaning container 12 provides an ultra clean, enclosed or sealed cleaning zone. Ultra cleanliness of the cleaning zone may be achieved by virtue of means, such as a blower motor 7, for passing system gases through an ultra purification filter, such as a ULPA filter 6, as shown in FIG. 2. A wafer 1 is held on a platen 2 by vacuum within the cleaning zone. The platen beneath the wafer is kept at a controlled temperature of up to 100° C. Liquid $CO_2$, from a cylinder at room temperature and 850 psi, is first passed through a sintered in-line filter 4 to filter out very small particles from the liquid stream to render the carbon dioxide as pure as possible and to reduce contaminants in the stream. The liquid $CO_2$ is then made to expand through a small aperture nozzle 3, preferably of from about 0.005" to 0.15" in diameter. The rapid expansion of the liquid causes the temperature to drop resulting in the formation of solid $CO_2$ snow particles entrained in a gaseous $CO_2$ stream flowing at a rate of approximately 1–3 cubic feet per minute. The stream of solid and gaseous $CO_2$ is directed at the wafer surface at an angle of about 30° to about 60°, preferably at an angle of about 45°. The nozzle is preferably positioned at a distance of approximately 0.375" to 0.5" measured along the line of sight of the nozzle to the wafer surface. During the cleaning process, the platen 2 moves back and forth on track 9 in the y direction while the arm 8 of the cleaning nozzle moves linearly on the track 10 in the x direction. This results in a rastered cleaning pattern on the wafer surface of which the step size and scan rate can be pre-set as desired. The humidity in the cleaning chamber is preferably maintained as low as possible, for example, <−40° C. dew point. The low humidity is present to prevent the condensation and freezing of water on the wafer surface from the atmosphere during the cleaning process which would increase the force of adhesion between the contaminant particles and the wafer surface by forming crystalline bridges between them. The low humidity can be maintained by the flow of nitrogen or clean dry air.

Throughout the cleaning process, it is important that the electrostatic charge in the cleaning chamber be neutralized. This is done by the bipolar corona ionization bar 5. The system also has a polonium nozzle mounted directly behind the $CO_2$ nozzle for enhancing the charge neutralization of the wafer which is mounted on an electrically grounded platen. The electrostatic charge develops by triboelectrification due to the flow of $CO_2$ through the nozzle and across the wafer surface. It is aided by the low humidity maintained in the cleaning chamber.

It is desirable to remove particulate contaminants, such as particulate contaminants that are submicron in size, such as less than or equal to about 0.13 $\mu$m in size, from the wafer surface. For particular contaminants, the removal mechanism is primarily by momentum transfer of the $CO_2$ cryogenic particles to overcome the force of adhesion of the contaminant particles on the wafer surface. Once the particles are "loosened", the drag force of the gaseous $CO_2$ removes them from the surface of the wafer. It is also desirable to remove organic film contaminants from the wafer surface. The cleaning mechanism for organic film contaminants is by the formation of a thin layer of liquid $CO_2$ at the interface of the organic contaminants and the surface due to the impact pressure of the cryogenic $CO_2$ on the wafer surface. The liquid $CO_2$ can then dissolve the organic contaminants and carry them away from the wafer surface.

The spraying of the gas or vapor in accordance with the present invention may occur in the same chamber as the cryogenic cleaning or it may be done in a separate chamber. As well, the cryogenic cleaning may be initiated simultaneously with or directly after the reactive gas or vapor is used. Depending on the gas or vapor used, for example water vapor, it may be desirable to purge the chamber of this vapor prior to initiating the cryogenic cleaning.

As a result of the use of the reactive gas or vapor, the removal of contaminants, particularly from etched features on a substrate surface, is significantly improved. This cleaning method is particularly beneficial in removing homogeneous contaminants such as a film of post etch residue on the sidewalls of vias and trenches or the photoresist remaining after etching.

The embodiments and examples of the present invention are meant to be illustrative of the present invention and not limiting. Other embodiments which could be used in the present process would be readily apparent to a skilled person. It is intended that such embodiments are encompassed within the scope of the present invention.

What is claimed is:

1. A method for removing at least one contaminant from a surface, comprising:

applying at least one reactant to the surface, the at least one reactant selected from a group consisting of ozone, hydrogen, nitrogen, nitrogen oxides, nitrogen triflouride, helium, argon, neon, sulfur trioxide, oxygen, fluorine, fluorocarbon gases, ethanol, acetone, ethanol-acetone mixtures, isopropyl alcohol, methanol, methyl formate, methyl iodide, and ethyl bromide, the at least one reactant in a form selected from a group consisting of a gas and a vapor, the at least one reactant sufficient for reacting with the at least one contaminant on the surface, wherein the at least one contaminant is other than a metal contaminant;

allowing the at least one reactant to condense on the surface; and applying cryogenic material to the surface.

2. The method of claim 1, wherein said applying at least one reactant and said applying cryogenic material occur simultaneously.

3. The method of claim 1, wherein said applying at least one reactant and said applying cryogenic material occur sequentially.

4. The method of claim 1, wherein said applying at least one reactant precedes said applying cryogenic material.

5. The method of claim 1, wherein the at least one contaminant comprises a material selected from a group consisting of organic material, inorganic material, metal-organic material, polymeric material, and particulate material.

6. The method of claim 1, wherein the at least one contaminant comprises a material of a type selected from a group consisting of residue material, photoresist material, film material, homogeneous material, and inhomogeneous material.

7. The method of claim 1, wherein the at least one contaminant material comprises particulate material that is less than or equal to about 0.13 $\mu$m in size.

8. The method of claim 1, wherein said applying the at least on reactant comprises allowing the at least one reactant to contact the surface for up to 20 minutes.

9. The method of claim 1, wherein during said applying the at least one reactant, the surface and the at least one reactant are at the same temperature.

10. The method of claim 1, wherein said applying the at least one reactant occurs at a pressure not to exceed atmospheric pressure.

11. The method of claim 1, wherein said applying the at least one reactant occurs at a temperature of up to 200° C.

12. The method of claim 1, further comprising generating reactive chemical species during said applying the at least one reactant.

13. The method of claim 1, wherein said applying the at least one reactant is in the presence of a free radical initiator.

14. The method of claim 13, wherein the free radical initiator is selected from a group consisting of ultraviolet light, x-ray, laser, corona discharge, and plasma.

15. The method of claim 1, wherein during said allowing the at least one reactant to condense, the surface is at a temperature that is less than that of the at least one reactant.

16. The method of claim 1, wherein the at least one contaminant is a particulate and said allowing the at least one reactant to condense is sufficient to lower a force of adhesion between the particulate and the surface.

17. The method of claim 1, wherein said applying cryogenic material comprises directing a stream of the cryogenic material at the surface.

18. The method of claim 1, wherein the cryogenic material comprises $CO_2$ gas and $CO_2$ particulates.

19. The method of claim 1, wherein said applying cryogenic material comprises physically cleaning the surface at low humidity.

20. The method of claim 1, wherein said applying cryogenic material comprises physically cleaning the surface at a dew point temperature of less than −40° C.

21. The method of claim 1, further comprising removing a byproduct of a reaction between the at least one reactant and the at least one contaminant from the surface.

22. The method of claim 21, wherein said removing comprises passing a flow of material selected from a group consisting of nitrogen and air across the surface.

* * * * *